US008281611B2

(12) United States Patent
Davis et al.

(10) Patent No.: US 8,281,611 B2
(45) Date of Patent: Oct. 9, 2012

(54) ICEMAKER FOR A REFRIGERATOR

(75) Inventors: Matthew William Davis, Prospect, KY (US); Stephen Bischoff, Louisville, KY (US); Darrell H. Kirby, LaGrange, KY (US); Pranav Mittal, Karnataka (IN)

(73) Assignee: General Electric Company, Schenectady, NY (US)

( * ) Notice: Subject to any disclaimer, the term of this patent is extended or adjusted under 35 U.S.C. 154(b) by 722 days.

(21) Appl. No.: 12/342,339

(22) Filed: Dec. 23, 2008

(65) Prior Publication Data

US 2010/0154458 A1 Jun. 24, 2010

(51) Int. Cl.
*F25C 1/14* (2006.01)

(52) U.S. Cl. ..... 62/354; 62/353; 62/344

(58) Field of Classification Search ..... 62/344, 62/353, 354, 345

See application file for complete search history.

(56) References Cited

U.S. PATENT DOCUMENTS

| | | | | |
|---|---|---|---|---|
| 6,216,471 | B1 * | 4/2001 | Patrick et al. | 62/71 |
| 7,017,364 | B2 | 3/2006 | Lee et al. | |
| 2004/0237563 | A1 * | 12/2004 | Lee et al. | 62/340 |
| 2006/0016209 | A1 * | 1/2006 | Cole et al. | 62/344 |
| 2006/0086135 | A1 | 4/2006 | Wu et al. | |
| 2006/0207282 | A1 | 9/2006 | Visin et al. | |
| 2007/0074527 | A1 * | 4/2007 | Lee et al. | 62/344 |

* cited by examiner

*Primary Examiner* — Cheryl J Tyler
*Assistant Examiner* — Orlando E Aviles Bosques
(74) *Attorney, Agent, or Firm* — Global Patent Operation; Douglas D. Zhang

(57) ABSTRACT

An automatic icemaker for a refrigerator is disclosed. The automatic icemaker includes an ice mold body having a front side, a back side, and a plurality of ice chambers for containing water therein for freezing into ice cubes, each ice chamber having a top opening having a frontal portion adjacent the front side; an ice stripper disposed along the front side and extending over the ice chambers, the ice stripper being configured to completely cover the frontal portion of the top opening of each ice chamber; and an ice rake disposed between the front side and the back side, the ice rake including a rotatable shaft, and a plurality of rake fingers extending outward from the shaft for moving ice cubes out of the respective ice chambers and onto the ice stripper.

20 Claims, 8 Drawing Sheets

ICEMAKER FOR A REFRIGERATOR

BACKGROUND OF THE INVENTION

The present invention relates generally to an icemaker for a refrigerator. More particularly, the present invention relates to an automatic icemaker for use on a door of a refrigerator.

Generally, a refrigerator includes a freezer compartment and a fresh food compartment which are partitioned from each other to store various foods at low temperatures in appropriate states for a relatively long time.

It is now common practice in the art of refrigerators to provide an automatic icemaker. In a "bottom freezer" type refrigerator where the freezer compartment is arranged below or beneath a top mounted fresh food compartment, convenience necessitates that the automatic icemaker be disposed in a thermally insulated ice compartment mounted or formed on the door for the top mounted fresh food compartment, and ice be delivered through an opening on the door for the fresh food compartment. Also, in a "side by side" type refrigerator where the freezer compartment is arranged next to the fresh food compartment, the automatic icemaker sometimes is also disposed on the door for one of the freezer compartment and the fresh food compartment, and ice is delivered through an opening formed on that door.

Positioning the automatic icemaker on the door of a refrigerator presents new challenges not previously encountered. One of such new challenges is water spillage problem. More specifically, when the door is opened or closed while water in the icemaker is not frozen, there is a good chance that the unfrozen water will spill out of the ice mold body of the icemaker. This is because the frontal opening of each ice chamber is not completely covered by the ice stripper. Such water spilling is not desirable because it results in no or smaller ice cubes. Additionally, the spilled water will likely fall into the ice storage bin positioned below the icemaker, causing the ice cubes in the ice storage bin to clump together.

Therefore, it would be desirable to provide an automatic icemaker which has a water spillage arrangement that not only prevents unfrozen water from escaping the ice mold body so that the water can be frozen into ice cubes, but also allows the ice cubes to be properly ejected from the ice mold body.

SUMMARY OF THE INVENTION

As described herein, the exemplary embodiments of the present invention overcome one or more of the above or other disadvantages known in the art.

One aspect of the present invention relates to an automatic icemaker for a refrigerator. The automatic icemaker includes an ice mold body having a front side, a back side, and a plurality of ice chambers for containing water therein for freezing into ice cubes, each ice chamber having a top opening having a frontal portion adjacent the front side; an ice stripper disposed along the front side and extending over the ice chambers, the ice stripper being configured to completely cover the frontal portion of the top opening of each ice chamber; and an ice rake disposed between the front side and the back side, the ice rake including a rotatable shaft, and a plurality of rake fingers extending outward from the shaft for moving ice cubes out of the respective ice chambers and onto the ice stripper.

Another aspect of the present invention relates to a refrigerator which includes a main body defining therein a food storage compartment with a frontal opening; a door rotatably attached to the main body for selectively closing the frontal opening of the food storage compartment; an ice compartment on the door, the ice compartment having a front wall which faces the interior of the food storage compartment when the door is closed; and an automatic icemaker disposed in the ice compartment. The automatic icemaker includes an ice mold body having a front side facing the front wall, a back side facing away from the front wall, and a plurality of ice chambers for containing water therein for freezing into ice cubes, each ice chamber having a top opening having a frontal portion adjacent the front side; an ice stripper extending upward and inward from the front side and over the ice chambers, the ice stripper being configured to completely cover the frontal portion of the top opening of each ice chamber; and an ice rake disposed between the front side and the back side, the ice rake including a rotatable shaft and a plurality of rake fingers extending outward from the shaft for carrying ice cubes out of the respective ice chambers and onto the ice stripper.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARILY EMBODIMENTS OF THE INVENTION

Figure 1:
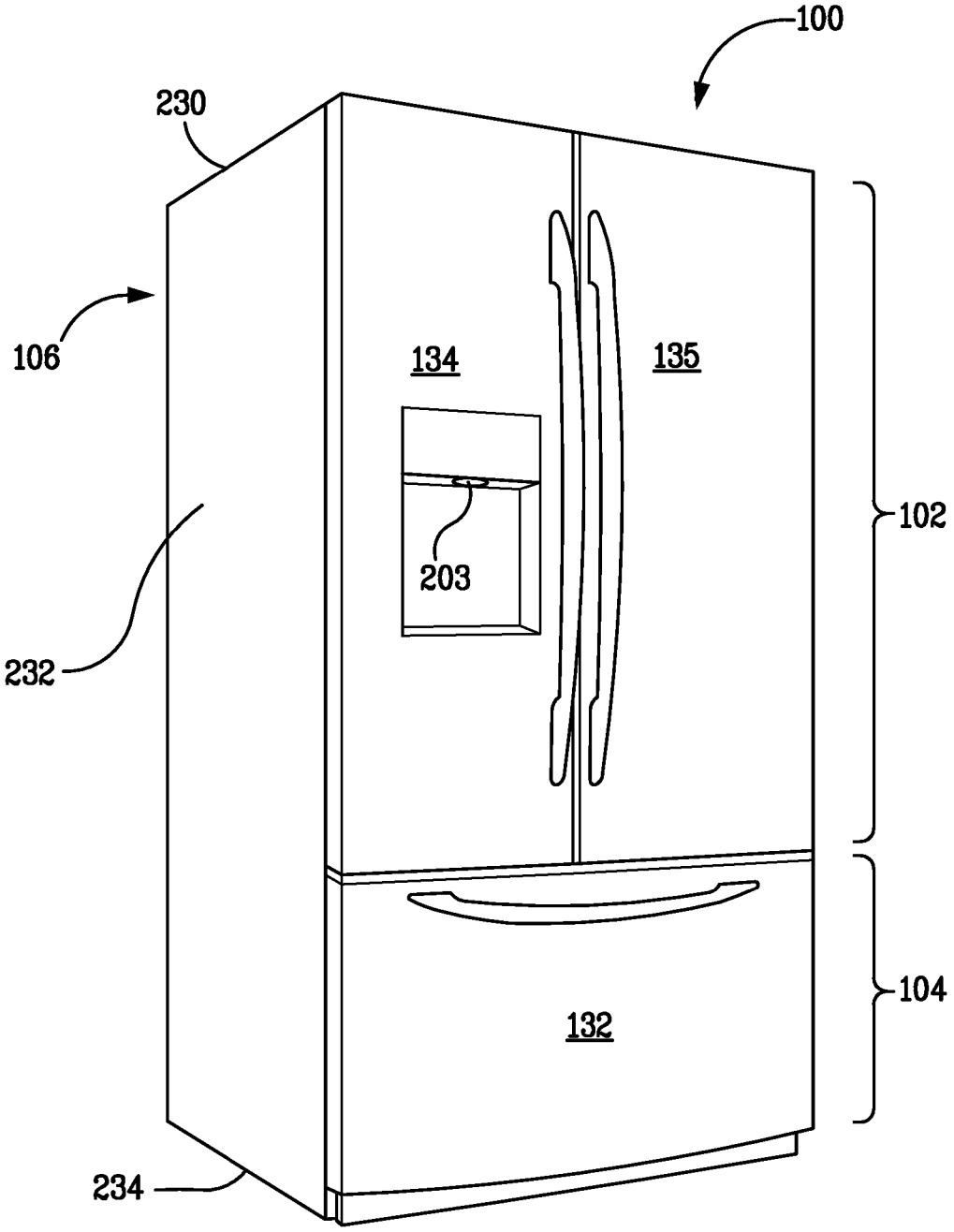
FIG. 1 is a perspective view of an exemplary "bottom freezer" refrigerator.
Figure 2:
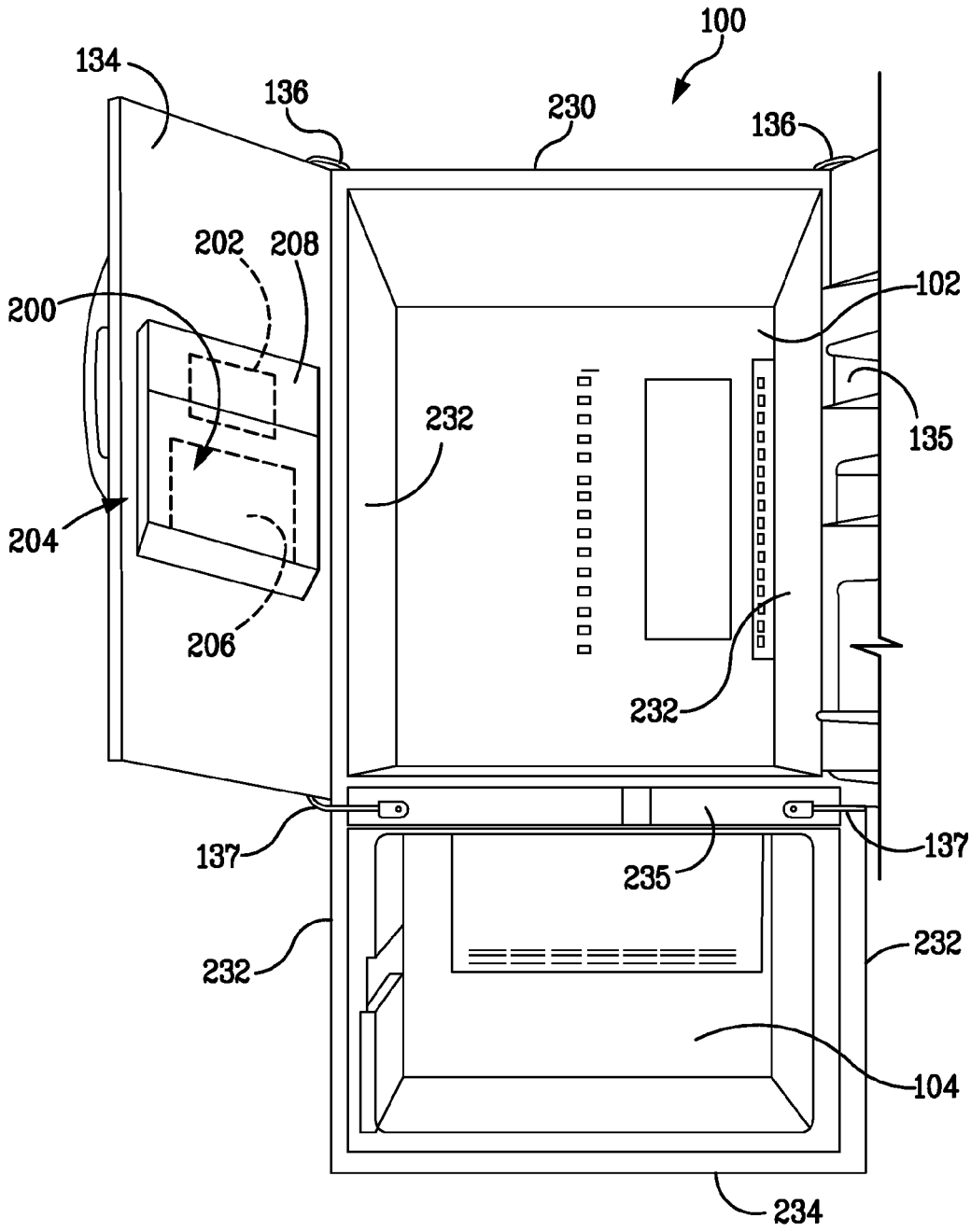
FIG. 2 is a simplified, perspective view of the refrigerator of FIG. 1 with the access doors of the fresh food compartment being in an open position and the drawer for the freezer compartment being removed for clarity.

FIGS. 1 and 2 illustrate an exemplary refrigerator 100 which includes food storage compartments such as a fresh food compartment 102 and a freezer compartment 104. The refrigerator 100 is coolable by a conventional vapor-compression temperature control circuit (not shown). Although the refrigerator 100 is shown as the "bottom freezer" type, the teaching of the description set forth below is applicable to other types of refrigeration appliances, including but not limited to, side-by-side refrigerators. The present invention is therefore not intended to be limited to any particular type or configuration of a refrigerator.

The freezer compartment 104 and the fresh food compartment 102 are arranged in a bottom mount configuration where the freezer compartment 104 is disposed or arranged beneath or below the fresh food compartment 102. The fresh food compartment 102 is shown with French doors 134 and 135. However, a single access door can be used instead of the French doors 134, 135. The freezer compartment 104 is closed by a drawer or an access door 132.

The fresh food compartment 102 and the freezer compartment 104 are contained or defined within a main body 106 of the refrigerator 100. The main body 106 includes a top wall 230 and two sidewalls 232. A mullion 235, best shown in FIG. 2, connects the two sidewalls 232 to each other and separates the fresh food compartment 102 from the freezer compartment 104. The main body 106 also has a bottom wall 234, which connects the two sidewalls 232 to each other at the bottom edges thereof, and a back wall (not shown).

The access door 132 and the French doors 134, 135 close frontal access openings of the freezer compartment 104 and the fresh food compartment 102, respectively.

Each French door 134, 135 is mounted to the main body 106 by a top hinge 136 and a corresponding bottom hinge 137, thereby being rotatable about its outer vertical edge between an open position for accessing the respective part of the fresh food compartment 102, as shown in FIG. 2, and a closed position for closing the respective part of the fresh food compartment 102, as shown in FIG. 1.

Similarly, when an access door 132 is used for the freezer compartment 104, it is rotatably mounted to the main body 106 in a known fashion. When a drawer is used for the freezer compartment 104, it is slidably received in the freezer compartment 104 in a known fashion.

As illustrated in FIG. 2, an ice making assembly 200 is mounted on the interior surface of the access door 134 of the fresh food compartment 102. The ice making assembly 200 can be mounted on the access door 135 instead. The ice making assembly 200 includes a substantially thermally insulated ice compartment 204 mounted or formed on the access door 134, and an exemplary automatic icemaker 202 in accordance with the present invention. The icemaker 202 is disposed in the ice compartment 204. Water is provided to ice chambers of the icemaker 202 through a water supply conduit (not shown) extending from the main body 106 of the refrigerator 100 to the icemaker 202, and then is frozen into ice cubes. The ice cubes are usually discharged from the icemaker 202 and stored in an ice storage bin 206 until needed by a user. The ice storage bin 206 is disposed in the ice compartment 204, below the icemaker 202. The ice cubes may be withdrawn by accessing the ice compartment 204 through an access door 208 which faces the fresh food compartment 102 when the access door 134 is closed. However, the ice cubes are typically withdrawn by using an ice dispenser (not shown) installed in the access door 134 through an opening 203 (shown in FIG. 1) formed on the exterior surface of the French door 134. The opening 203 faces away from the fresh food compartment 102 when the access door 134 is closed and is formed at a height facilitating convenient access to the ice. These are known in the art and therefore will not be discussed in detail here.

Figure 3:
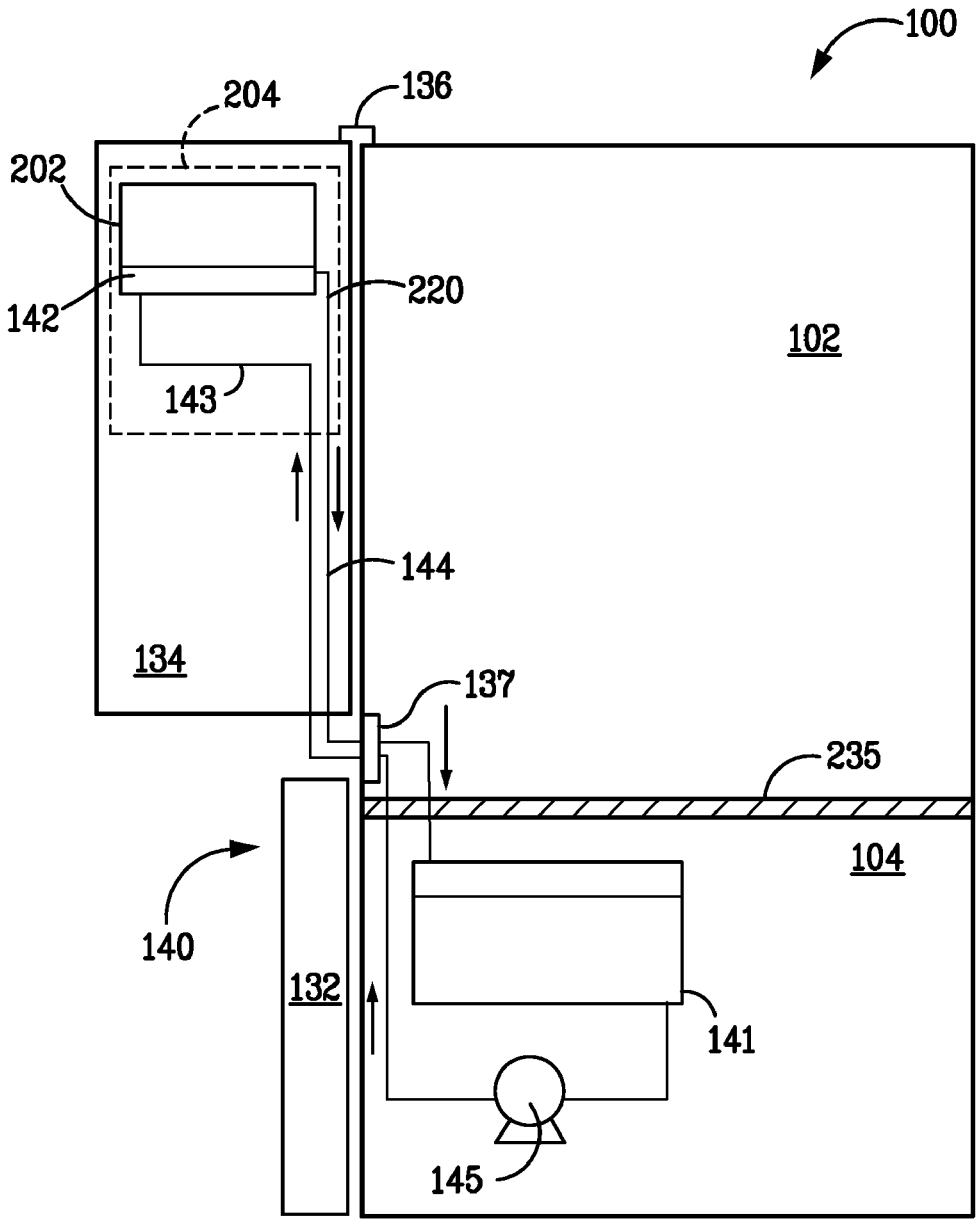
FIG. 3 schematically shows an exemplary icemaker and a secondary temperature control circuit used in the refrigerator of FIG. 1.

Because the ice compartment 204 is located in the fresh food compartment 102 which normally has a temperature higher than the freezing point of water, warming of the interior of the ice compartment 204 occurs. To counter this warming, a secondary temperature control circuit is used to circulate a working medium to and from the icemaker 202 and/or the ice compartment 204. As shown in FIG. 3, when the working medium is a liquid, such as a food safe liquid in the nature of a mixture of propylene glycol and water, the second temperature control circuit 140 includes a first heat exchanger 141 disposed in the freezer compartment 104, a second heat exchanger 142 thermally coupled to or formed as part of the ice mold body of the icemaker 202, a supply conduit 143 and a return conduit 144 between the first and second heat exchangers 141, 142, and a working medium moving device such as pump 145 for circulating the working medium in the second temperature control circuit 140. The working medium is cooled when it passes through the first heat exchanger 141. The pump 145 forces the cooled working medium to pass through the second heat exchanger 142 to keep the temperature of the icemaker 202 below the freezing point of water. Such a second temperature control circuit is discussed in greater detail in commonly owned application Ser. No. 11/958,900, filed Dec. 18, 2007, the entire content of which is incorporated herein by reference.

When the working medium is air, the secondary temperature control circuit includes a supply conduit (not shown) and a return conduit (not shown) between the freezer compartment 104 and the ice compartment 204, and a working medium moving device such as fan (not shown) for causing cooling air in the freezer compartment 104 to flow to the ice compartment 204 via the supply conduit and the air in the ice compartment 204 to flow back to the freezer compartment 104 via the return path. This configuration is known in the art, and therefore will not be discussed further here.

Figure 4:
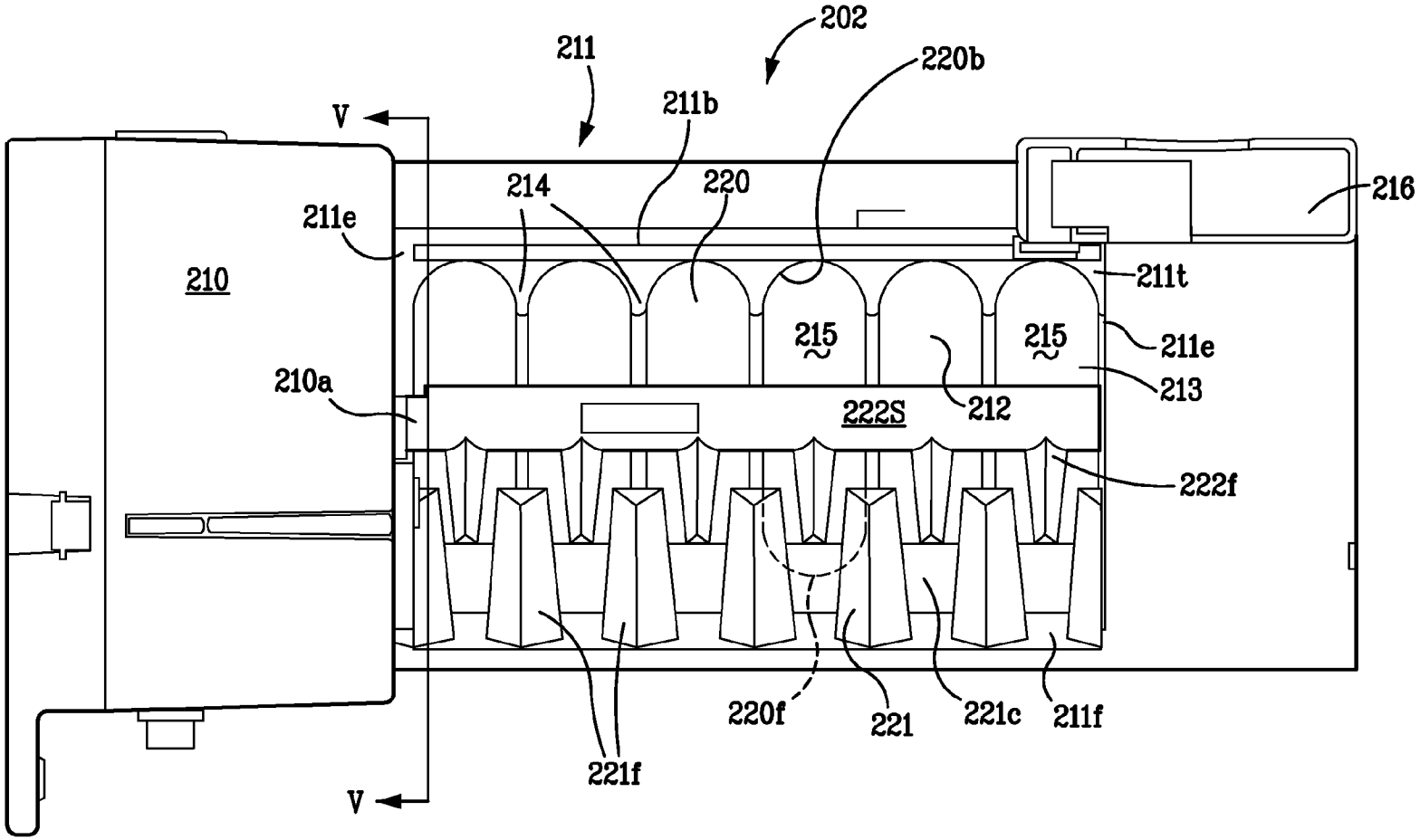
FIG. 4 is a top view of the icemaker of FIG. 3.

As clearly shown in FIG. 4, the icemaker 202 includes a motor 210 and an ice mold body 211. The ice mold body 211 has a front side 211*f*, a back side 211*b*, and two end sides 211*e*. One of the end sides 211*e* is attached to the motor 210, and the other is disposed remote from the motor 210.

The ice mold body 211 also has a bottom wall 212 with its curved inner surface 213 extending generally longitudinally along the length of the ice mold body 211, and a plurality of partial partition walls 214 extending transversely across the ice mold body 211 to define a plurality of ice chambers 215. As is known in the art, ice cubes can be formed in these ice chambers 215. Each partial partition wall 214 preferably has a recessed upper edge portion (not shown) through which water flows successively from one ice chamber to the next to fill all of the ice chambers 215. The icemaker 202 can have a water inlet element 216 supported by the ice mold body 211 (see FIGS. 4 and 6) for directing water from the water supply conduit into the ice chambers 215 as is known in the art.

As clearly shown in FIG. 4, each ice chamber 215 preferably has a generally race-track shaped top opening 220 terminating at the top surface 211*t* of the ice mold body 211. In this embodiment, each top opening 220 has a substantially semi-circular frontal portion 220*f* adjacent the front side 211*f*, and a substantially semi-circular back portion 220*b* adjacent the back side 211*b*.

Figure 5:
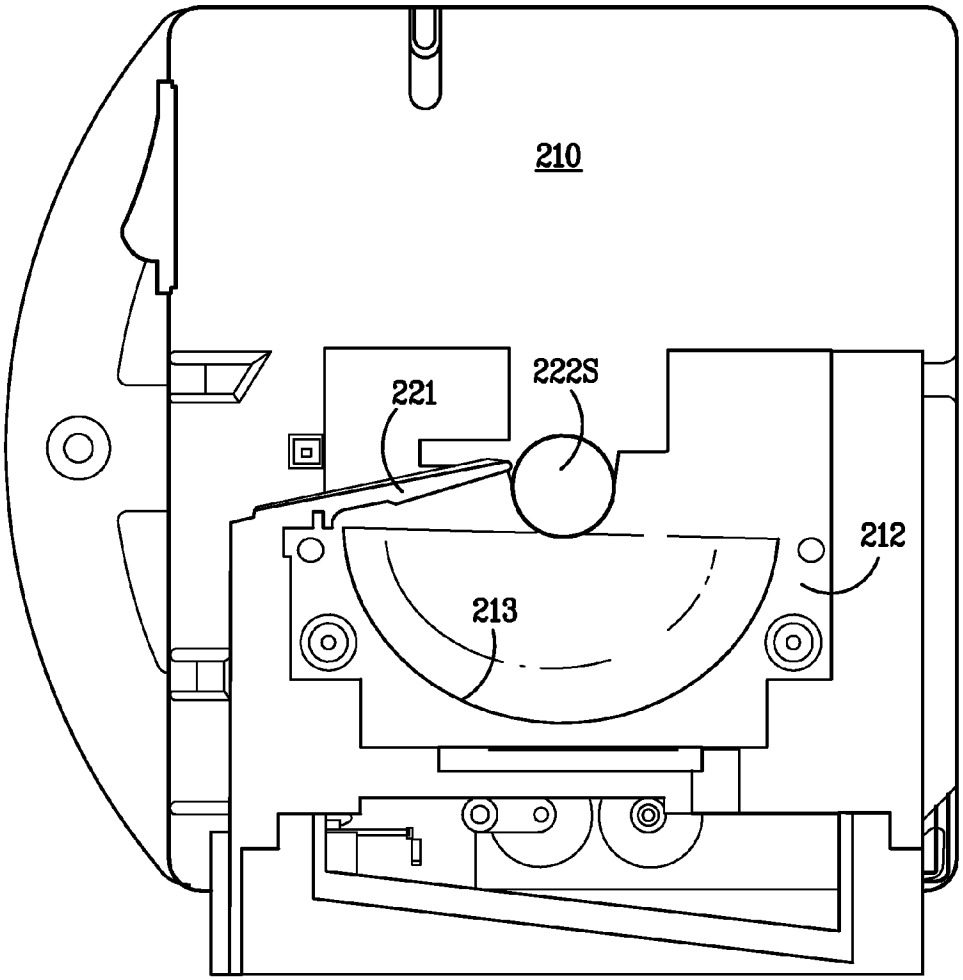
FIG. 5 is a view along line V-V in FIG. 4.

The icemaker 202 also has an ice stripper 221, which is disposed along the front side 211*f* of the ice mold body 211 and partially covers the top openings 220. As clearly shown in FIG. 5, the ice stripper 221 preferably extends upward and inward from the front side 211*f* as is known in the art. As illustrated in FIG. 4, in this embodiment, the ice stripper 221 has a plurality of stripper fingers 221*f* preferably disposed over and aligned with the respective partial partition walls 214, and a plurality of covers 221*c*. Each cover 221*c* is disposed between two adjacent stripper fingers 221*f* for substantially completely covering the respective frontal portion 220*f*. The stripper fingers 221*f* are longer than the covers 221*c*. The covers 221*c* are used to prevent or substantially reduce water spillage (i.e., unfrozen water flowing out of the icemaker 202) when the door 134 is opened or closed.

The icemaker 202 also has an ice rake or ejector 222 including a rotatable shaft 222*s* disposed preferably slightly above the ice chambers 215 and at approximately midway between the frontal portions 220*f* and the back portions 220*b*, and a plurality of rake fingers 222*f* extending radially outwardly from the shaft 222*s* and over the respective ice chambers 215. In this embodiment, each rake finger 222*f* has a length so that it extends into the gap formed between the two respective adjacent stripper fingers 221*f*, but it does not touch the respective cover 221*c* when the shaft 222*s* rotates 360 degrees. One end of the shaft 222*s* is connected to the axle 210*a* of the motor 210. As is known in the art, when the motor 210 is activated, it rotates the shaft 222*s*, and the rake fingers 222*f* move ice cubes from the respective ice chambers 215 to the ice stripper 221 during ice harvesting. In this embodiment, the motor 210 is an AC motor, and the shaft 222*s* rotates approximately 360 degrees in a harvesting cycle. The icemaker 202 preferably has a heating element (not shown) which is used to heat ice mold body 211 when a harvest cycle begins in order to slightly melt ice cubes to allow the ice cubes to be more easily released from the ice chambers 215.

Figure 6:
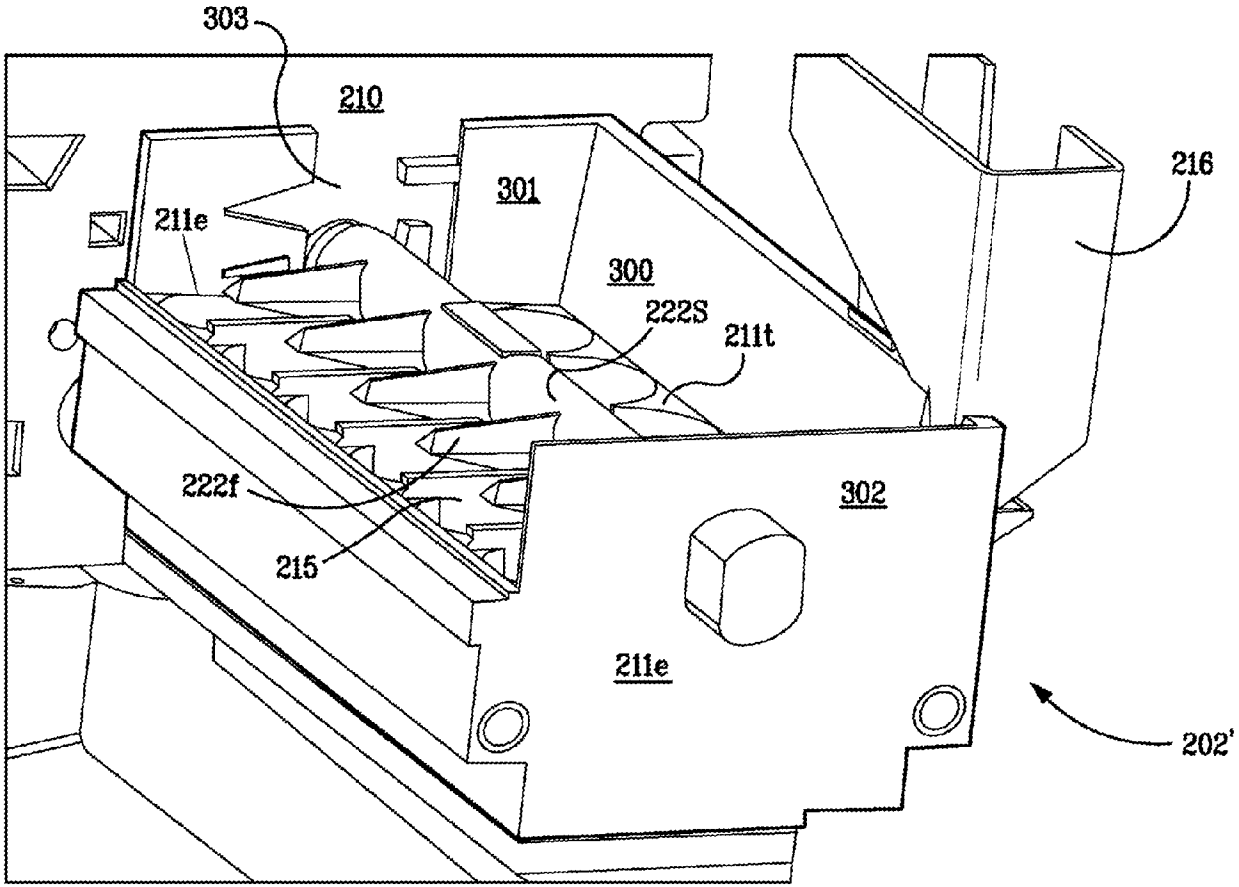
FIG. 6 is a partial, perspective view, showing a variation of the icemaker of FIG. 4, where the ice stripper is removed for clarity.

FIG. 6 shows another variation of the icemaker 202. In this variation, the same or similar reference numerals have been used to designate the same or similar components. As clearly shown in FIG. 6, the icemaker 202' has a back wall 300 which is adjacent the back side 211*b* and extends upward from the top surface 21 it of the ice mold body 211, two sidewalls 301, 302 adjacent the respective end sides 211*e*, and extend upward from the top surface 211*t*. The sidewall 301 has a central opening 303 to receive the shaft 222*s*. The back wall 300, the sidewalls 301, 302 are used to prevent or substantially reduce water spillage when the door 134 is in motion.

Figure 7:
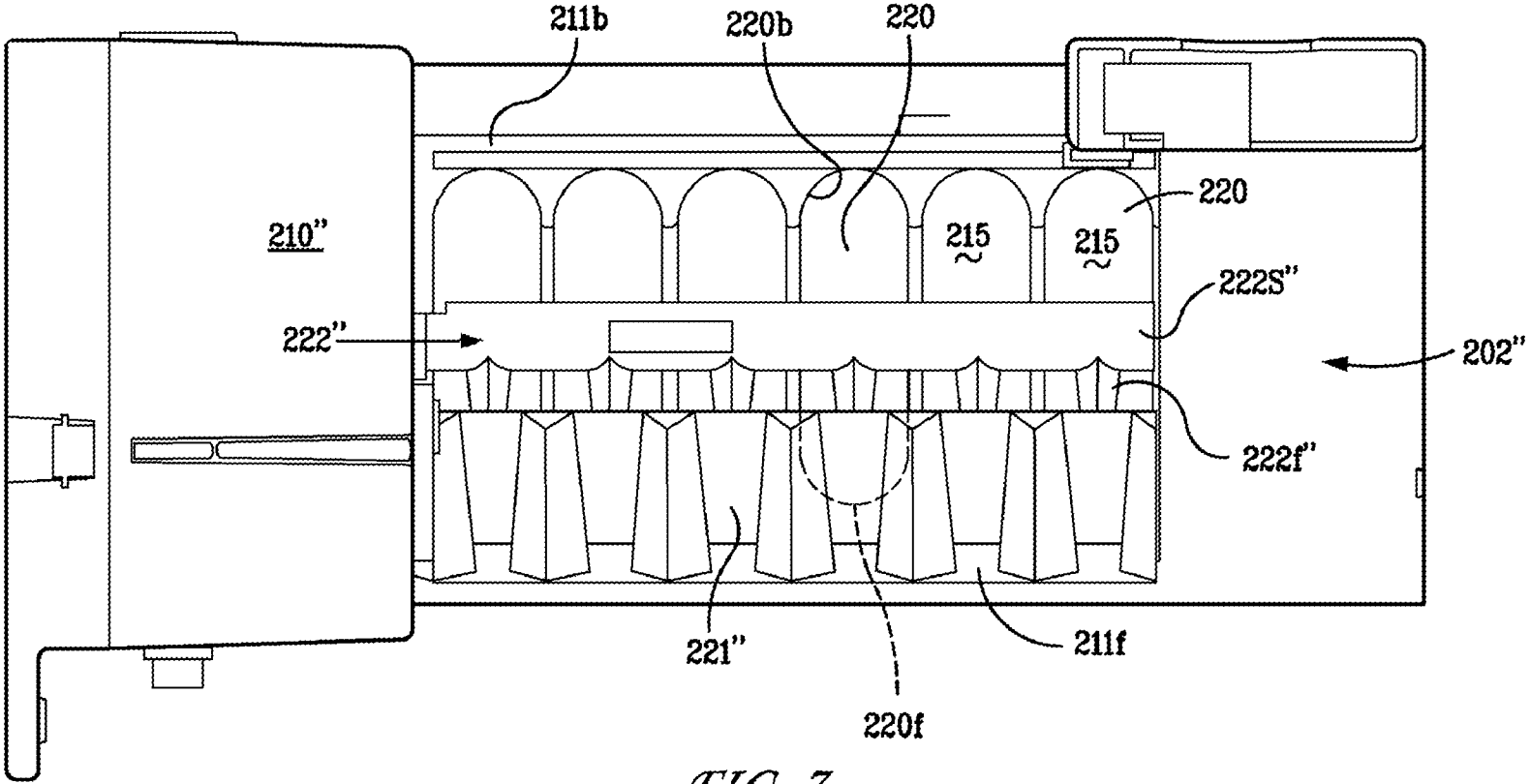
FIG. 7 is a top view of yet another variation of the icemaker of FIG. 4.

FIG. 7 shows yet another variation of the icemaker 202. Again, in this variation, the same or similar reference numerals have been used to designate the same or similar components. There are at least three differences between the icemaker 202" shown in FIG. 7 and the icemaker 202 shown in FIG. 4. First, unlike the ice stripper 221 shown in FIG. 4, in this variation, the ice stripper 221" is a continuous, solid element. In other words, the ice stripper 221" has no stripper fingers over the top openings 220 of the ice chambers 215. The ice stripper 221" is attached to ice mold body 211 so that water cannot pass between the ice stripper 221" and the front side 211*f*. Because the ice stripper 221" extends over the frontal portions 220*f* of the top openings 220, when the water flows out of the ice chambers 215 because of the movement of the door 134, the water contacts the solid ice stripper 221" and is directed back into the ice chambers 215. Second, the ice rake 222" has rake fingers 222*f"* that extend under the ice stripper 221" when the ice rake 222" is in its initial position and therefore would touch the ice stripper 221" if the shaft 222*s"* rotates 360 degrees. In other words, the ice rake 222" cannot rotate a full 360 degrees as is done in traditional icemakers during the harvest cycle. Therefore, the ice rake 222" is returned to its initial position after the harvest cycle by any known means, including but not limited to, a reversible motor such as a direct current or DC motor and a return biasing spring. In this variation, a DC motor is used. This is the third difference between the icemakers 202" and 202.

Figure 9:
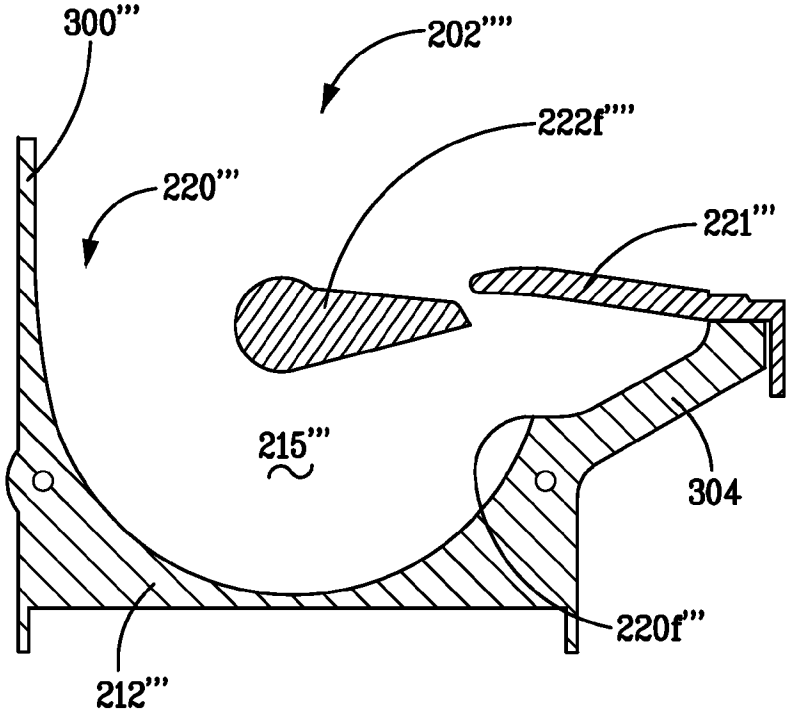
FIGS. 8 and 9 are cross sectional views, showing two more variations of the icemaker of FIG. 4.
Figure 8:
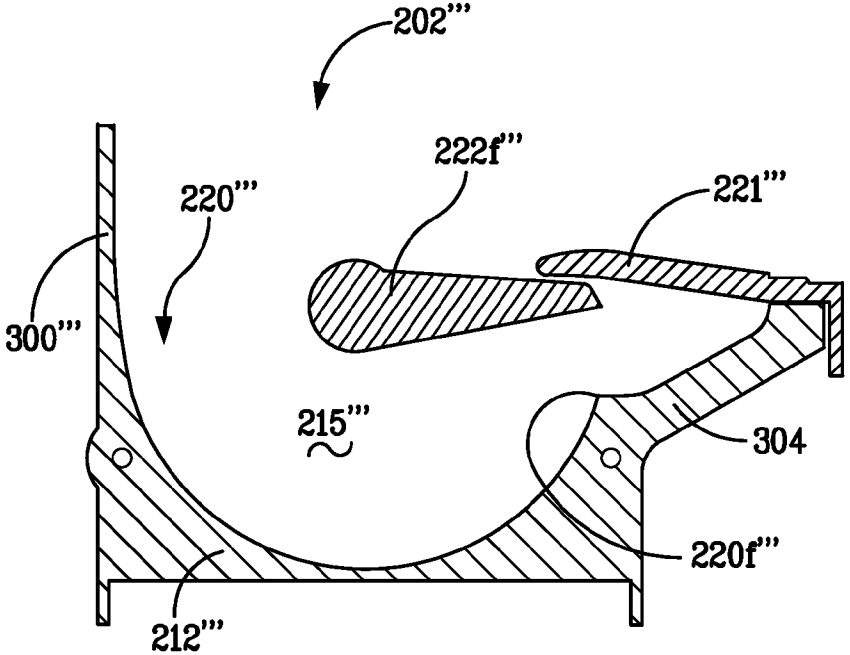

FIGS. 8 and 9 show two more variations of the icemaker 202. As clearly shown in FIGS. 8 and 9, the ice mold body 202''', 202'''' has an extension wall 304 which extends upward and outward from the front, top edge of the bottom wall 212'''. The ice stripper 221''', which is solid, is supported by the extension wall 304. Both the ice stripper 221''' and the extension wall 304 are used to direct spilled water back to the ice chambers 215''' when the door 134 is in motion. The extension wall 304 allows the use of longer rake fingers. Generally, longer rake fingers are preferred because they provide a greater carrying and breaking force for the ice cubes. Preferably, the ice stripper 221''' extend to cover the frontal portions 220*f'''* of the top openings 220''' of the ice chambers 215'''. The ice mold body 202''', 202'''' also has the back wall 300''' which extends upward from the back, top edge of the bottom wall 212'''. In FIG. 8, the rake fingers 222*f'''* are similar to those shown in FIG. 7 in that they also extend under the ice stripper 221''' in their initial position. As a result, in this variation, a DC motor is used to drive the shaft. The rake fingers 222*f''''* in FIG. 9, on the other hand, are similar to those shown in FIG. 4 in that they do not touch the ice stripper 221''' when rotating.

While the invention has been described in terms of various specific embodiments, those skilled in the art will recognize that the invention can be practiced with modification within the spirit and scope of the claims. For example, features of various embodiments/variations can be combined. Thus, while there have shown, described and pointed out fundamental novel features of the invention as applied to various specific embodiments thereof, it will be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An automatic icemaker for a refrigerator, comprising:

an ice mold body comprising a front side, a back side, and a plurality of ice chambers for containing water therein for freezing into ice cubes, each ice chamber comprising a top opening comprising a frontal portion adjacent the front side;

an ice stripper comprising a plurality of stripper fingers and a plurality of covers, each cover of the plurality of covers is disposed between two respective adjacent stripper fingers so that there are no openings in the ice stripper, and there are no openings between the plurality of covers and the plurality of stripper fingers, wherein the plurality of stripper fingers and the plurality of covers are disposed along the front side and extend inward in direction towards the back side, where in an end edge of the plurality of stripper fingers and the plurality of covers form a common edge, the common edge being located opposite the front side and extending over the ice chambers to completely cover the frontal portion of the top opening of each ice chamber to prevent any water residing in the ice chambers from spilling over the front side of the ice mold body; and an ice rake disposed between the front side and the back side, the ice rake comprising a rotatable shaft, and a plurality of rake fingers extending outward from the shaft for moving ice cubes out of the respective ice chambers and onto the ice stripper.

2. The automatic icemaker of claim 1, wherein the ice mold body further has a curved bottom wall having a top edge adjacent the front side, and an extension wall extending outward and upward from the top edge of the curved bottom wall, the ice stripper being supported by the extension wall.

3. The automatic icemaker of claim 1, further comprising a reversible DC motor for rotating the shaft of the ice rake.

4. The automatic icemaker of claim 3, wherein the plurality of rake fingers are rotatable, less than 360 degrees, in a forward direction from a first position to a second position and a reverse direction from the second position to the first position.

5. The automatic icemaker of claim 4, wherein the frontal portion of the top opening of each ice chamber is covered by a respective cover.

6. The automatic icemaker of claim 4, wherein each rake finger has a length so that when the shaft rotates, the each rake finger will not touch the ice stripper.

7. The automatic icemaker of claim 4, wherein each rake finger is disposed between two respective adjacent stripper fingers, the each rake finger having a length so that when the shaft rotates, the each rake finger will not touch the cover disposed between the two respective adjacent stripper fingers.

8. The automatic icemaker of claim 1, wherein the ice mold body further has a back wall which is adjacent the back side and extends above the ice chambers.

9. The automatic icemaker of claim 8, wherein the ice mold body further has two end sides, and two end walls which are adjacent to the respective end sides and extend above the ice chambers.

10. A refrigerator comprising:

a main body defining therein a food storage compartment with a frontal opening;

a door rotatably attached to the main body for selectively closing the frontal opening of the food storage compartment;

an ice compartment on the door, the ice compartment comprising a front wall which faces the interior of the food storage compartment when the door is closed; and an automatic icemaker disposed in the ice compartment, the icemaker comprising:

an ice mold body comprising a front side facing the front wall, a back side facing away from the front wall, and a plurality of ice chambers for containing water therein for freezing into ice cubes, each ice chamber comprising a top opening comprising a frontal portion adjacent the front side;

an ice stripper comprising a plurality of stripper fingers and a plurality of covers, each cover of the plurality of covers is disposed between two respective adjacent stripper fingers so that there are no openings in the ice stripper, and there are no openings between the plurality of covers and the plurality of stripper fingers, wherein the plurality of stripper fingers and the plurality of covers are disposed along the front side and extend inward in direction towards the back side, where in an end edge of the plurality of stripper fingers and the plurality of covers form a common edge, the common edge being located opposite the front side and extending over the ice chambers to completely cover the frontal portion of the top opening of each ice chamber to prevent any water residing in the ice chambers from spilling over the front side of the ice mold body; and an ice rake disposed between the front side and the back side, the ice rake comprising a rotatable shaft, and a plurality of rake fingers extending outward from the shaft for carrying ice cubes out of the respective ice chambers and onto the ice stripper.

11. The refrigerator of claim 10, wherein the ice stripper comprises a continuous surface configured to completely cover the frontal portion of the top opening of the plurality of ice chambers.

12. The refrigerator of claim 11, wherein the ice mold body further has a curved bottom wall having a top edge adjacent the front side, and an extension wall extending outward and upward from the top edge of the curved bottom the ice stripper being supported by the extension wall.

13. The refrigerator of claim 11, further comprising a reversible DC motor for rotating the shaft of the ice rake.

14. The refrigerator of claim 13, wherein the plurality of rake fingers are rotatable, less than 360 degrees, in a forward direction from a first position to a second position and a reverse direction from the second position to the first position.

15. The refrigerator of claim 14, wherein the frontal portion of the top opening of each ice chamber is covered by a respective cover.

16. The refrigerator of claim 14, wherein each rake finger has a length so that when the shaft rotates, the each rake finger will not touch the ice stripper.

17. The refrigerator of claim 14, wherein each rake finger is disposed between two respective adjacent stripper fingers, the each rake finger having a length so that when the shaft rotates, the each rake finger will not touch the cover disposed between the two respective adjacent stripper fingers.

18. The refrigerator of claim 10, wherein the ice mold body further has a back wall which is adjacent the back side and extends above the ice chambers.

19. The refrigerator of claim 18, wherein the ice mold body further has two end sides, and two end walls which are adjacent to the respective end sides and extend above the ice chambers.

20. The refrigerator of claim 10, wherein the food storage compartment is a fresh food compartment, the main body further defining therein a freezer compartment which is disposed below the fresh food compartment.

* * * * *